US005199345A

United States Patent [19]

Meier

[11] Patent Number: 5,199,345

[45] Date of Patent: Apr. 6, 1993

[54] PISTON COMPRESSOR FOR THE OILFREE COMPRESSION OF A GAS

[75] Inventor: Hans Meier, Kollbrunn, Switzerland

[73] Assignee: Maschinenfabrik Sulzer-Burckhardt AG, Basel, Switzerland

[21] Appl. No.: 902,190

[22] Filed: Jun. 22, 1992

[30] Foreign Application Priority Data

Aug. 12, 1991 [CH] Switzerland ..... 2381/91

[51] Int. Cl.[5] ..... F04B 21/04

[52] U.S. Cl. ..... 92/141; 92/82; 92/168; 277/153; 277/206 R

[58] Field of Search ..... 92/141, 153, 168, 82, 92/86, 87; 277/153, 206 R; 184/6.5, 24, 25

[56] References Cited

U.S. PATENT DOCUMENTS

| | | | |
|---|---|---|---|
| 1,960,927 | 5/1934 | Siegert | 92/168 |
| 2,204,374 | 6/1940 | Metzgar . | |
| 2,878,990 | 3/1959 | Zurcher | 92/153 |
| 4,140,442 | 2/1979 | Mulvey | 92/168 |

FOREIGN PATENT DOCUMENTS

| | | | |
|---|---|---|---|
| 513421 | 5/1955 | Canada | 184/24 |
| 0424310A1 | 4/1991 | European Pat. Off. . | |
| 1083480 | 6/1960 | Fed. Rep. of Germany . | |
| 905650 | 9/1962 | United Kingdom . | |

*Primary Examiner*—Edward K. Look
*Assistant Examiner*—F. Daniel Lopez
*Attorney, Agent, or Firm*—Townsend and Townsend; Townsend and Townsend Khourie and Crew

[57] ABSTRACT

The piston compressor exhibits at least one piston (7) which is supported to be freefloating and connected via a piston rod (6) to a crosshead (5). The piston rod slides in a guide bearing (8) next to the crosshead in a gland (11) next to the cylinder. A ring (15) of porous material is arranged on the piston rod (6) between the guide bearing (8) and the gland (11). The ring (15) exhibits a circumferential groove which is intended for receiving a tubular spring and the depth of which—measured from the outside transversely to the longitudinal axis (6') of the piston rod—is at least as great as the outer diameter of one turn of the tubular spring.

1 Claim, 1 Drawing Sheet

PISTON COMPRESSOR FOR THE OILFREE COMPRESSION OF A GAS

BACKGROUND OF THE INVENTION

The invention is concerned with a piston compressor for the oilfree compression of a gas, especially oxygen, having at least one piston which is supported to be freefloating and is connected via a piston rod to a crosshead, the piston rod sliding in a guide bearing next the crosshead and in a gland next the cylinder.

In the case of such compressors in which the guide bearing is usually provided with oil scraper rings, the formation of a thin film of oil on the piston rod cannot be avoided on that portion of the piston rod which slides through the guide bearing. In the case of deficient functioning of the oil scraper rings, e.g., because of their having slowly worn away, this oil film can start to travel up the piston rod and thus push forward in the direction of the gland, which must be prevented especially when the piston compressor is serving for the comrpession of oxygen. In order to impede an advance of oil in the direction of the gland it has been usual hitherto to arrange on the piston rod a rubber ring which by means of a tubular spring is pressed against the piston rod which furthermore exhibits a recess into which the inner face of the rubber ring is embedded. The rubber ring indeed halts the advance of the oil film up the piston rod but itself becomes wet on the surface and can thus become a flinger ring for oil droplets which form on the ring itself. Oil droplets may also be flung off directly from the turns of the tubular spring because the tubular spring projects beyond the circumferential area of the rubber ring. Thus oil droplets flung off from the rubber ring and/or from the tubular spring may equally well arrive in the region of the gland.

SUMMARY OF THE INVENTION

The problem underlying the invention is to improve a piston compressor of the kind named initially, in such a way that no oil any longer arrives in the region of the gland whether it be through advance as an oil film up the piston rod or through the flinging of oil droplets.

This problem is solved in accordance with the invention by a ring of porous material being arranged on the piston rod between the guide bearing and the gland and by the ring exhibiting a circumferential groove which is intended for receiving a tubular spring and the depth of which—measured from outside transversely to the longitudinal axis of the piston rod —rod is at least as great as the outer diameter of one turn of the tubular spring.

Through the ring in accordance with the invention consisting of porous material oil advancing up the piston rod becomes sucked up by the ring and stored in it. Before the ring is saturated with oil this is removed from the ring by washing and the ring is then built in again. Another possibility consists in the ring enriched with oil being replaced by a dry ring. Since only small amounts of oil are on the way it takes a long time until the volume of ring is saturated. Through the depth of the circumferntial groove being as claimed it is achieved that the tublar spring no longer projects beyond the outer face of the ring so that any oil droplets happening to collect on the turns of the tubular spring remain within the circumferential groove and cannot become flung away from the region of the ring.

DETAILED DESCRIPTION OF THE PREFERRED EMBODIMENT

Figure 1:
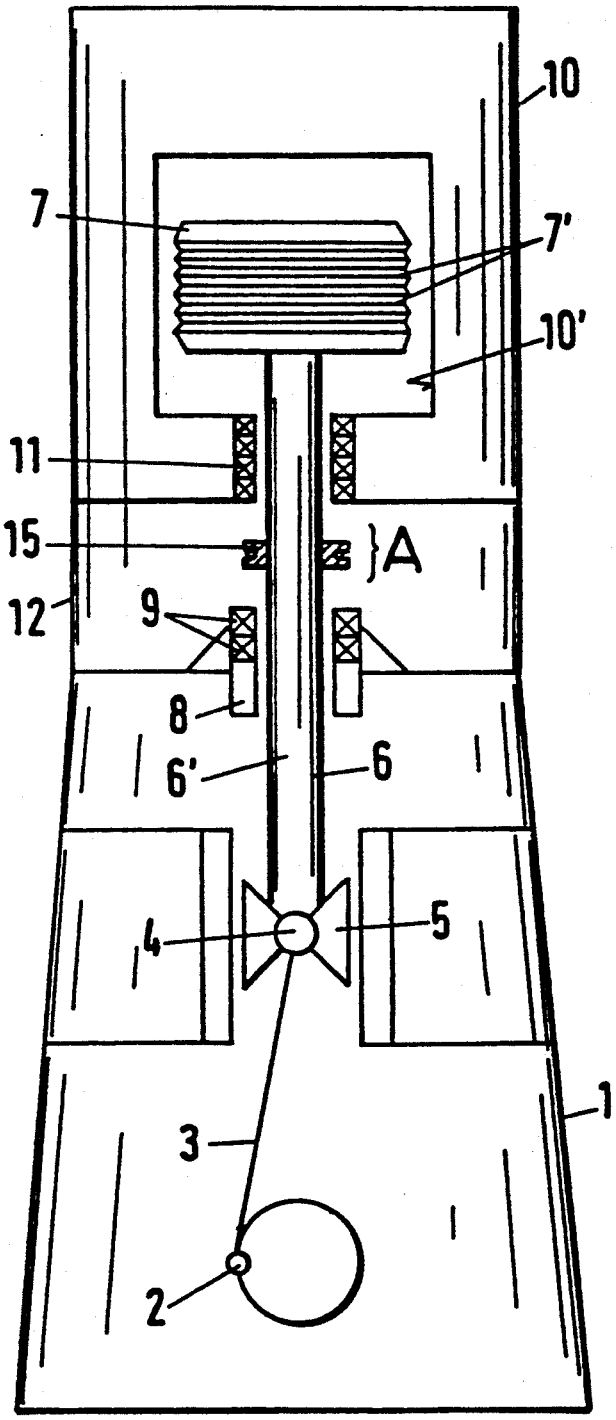
FIG. 1 is a longitudinal section through a compressor.

In accordance with FIG. 1 the piston compressor being of vertical construction, intended, e.g., for the compression of oxygen, exhibits sa crankcase 1 in which is supported a crankshaft not shown in greater detail, the crankpin 2 of which is connected in a hinge to a connecting-rod 3.

The top end of the connecting-rod 3 is connected in a hinge to a gudgeon pin 4 which is part of a crosshead 5 movable up and down vertically in a straight line. The bottom end of a piston rod 6 is fastened to the crosshead 5 and carries at its top end a piston 7. The piston rod 6 slides in a guide bearing 8 fastened to the top end of the crankcase 1 and provided at the end of it projecting from the crankcase with oil scraper rings 9.

This piston 7 lies in a cylinder block 10 provided at its bottom end with a gland 11 which-just like the guide bearing 8 and oil scraper rings 9-surrounds the piston rod 6 in close contact. In this way the piston 7 is supported to be freefloating in the cylinder block 10. The cylindrical outer face of the piston 7 is provided with labyrinth grooves 7' so that when the compressor is in operation the piston 7 moves up and down without touching the adjacent cylinderwall 10'. Between the cylinder block 10 and the crank case 1 a spacer 12 is provided which connects the 3wo housings 1 and 10 together.

Figure 2:
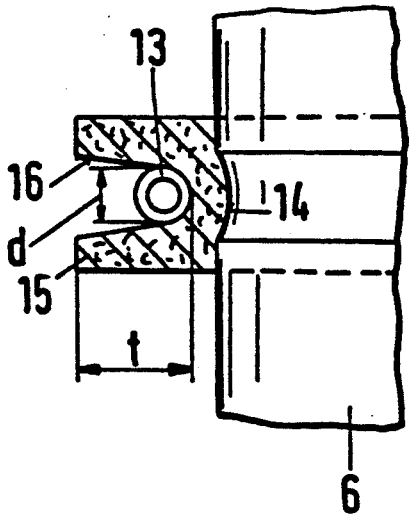
FIG. 2 is an enlarged, fragmentary view of detail A in FIG. 1.

In the region of the spacer 12 a ring 15 exhibiting an essentially rectangular cross-section is arranged on the piston rod 6, and as shown in FIG. 2 is seated firmly on the piston rod 6 and moves together with it in operation of the compressor. For this purpose a recess 14 is machined into the piston rod 6, into which the ring 15 projects by its correspondingly shaped inner face. The ring 15 is then pressed by a tubular spring 13 against the piston rod 6.

The ring 15 consists of porous material which is capable of sucking up oil droplets advancing upwards along the piston rod 6 from below and storing them in itself. The material coming into question for that is, e.g., a plastics of polyurethane exhibiting a porous structure or a body of aluminium granules stuck together with a plastics as a binder, or even a porous body of cellular material. What is essential is that the ring 15 both in the built-in oil-free state and in the state fully soaked with oil shall remain stable in shape.

For receiving the tubular spring 13 the ring 15 exhibits on the outside a groove 16 running in the circumferential direction, the depth t of which—measured transversely to the longitudinal axis 6' the piston rod—is at least equal to the diameter d of a turn of the tubular spring 13. Through this dimensional prescription it is achieved that the tubular spring 13 does not stand out beyond the outer circumferential face of the ring 15. Depending upon the choice of material the ring is either not cut transversly to its circumference or is cut once so that in assembly it may be widened elastically, or it consists of at least two ring segments.

I claim:

1. A piston compressor for the oilfree compression of a gas having at least one piston which is supported to be freefloating and is connected via a piston rod to a crosshead, the piston rod sliding in a guide bearing next to the crosshead and in a gland next to the cylinder, characterized in that a ring of porous material is arranged on the piston rod between the guide bearing and the gland and that the ring includes a circumferential groove which receives a tubular spring, the depth of the circumferential groove—measured from outside transversely to the longitudinal axis of the piston rod—being at least as great as the outer diameter of one turn of the tubular spring.

* * * * *